US006194649B1

(12) United States Patent
Itou et al.

(10) Patent No.: US 6,194,649 B1
(45) Date of Patent: Feb. 27, 2001

(54) KEYBOARD MUSICAL INSTRUMENT EQUIPPED WITH PARTIALLY REPAIREABLE CHANGE-OVER MECHANISM FOR CHANGING HAMMER STOPPER

(75) Inventors: Katsuo Itou; Takashi Tamaki, both of Shizuoka-ken (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/561,059

(22) Filed: Apr. 28, 2000

(30) Foreign Application Priority Data

May 6, 1999 (JP) ..... 11-126332

(51) Int. Cl.[7] ..... G10H 1/32

(52) U.S. Cl. ..... 84/719; 84/171; 84/220; 84/236

(58) Field of Search ..... 84/2, 3, 171, 174, 84/216, 219–222, 236, 239, 719

(56) References Cited

U.S. PATENT DOCUMENTS 5,565,636 10/1996 Sugiyama .
5,583,306 * 12/1996 Hayashida et al. ..... 84/171
5,600,077 2/1997 Honda .
5,602,351 * 2/1997 Kawamura et al. ..... 84/220 X
5,874,687 * 2/1999 Kawamura ..... 84/220 X
5,949,013 9/1999 Satoshi .
6,011,214 * 1/2000 Kawamura ..... 84/220 X

FOREIGN PATENT DOCUMENTS 230279 8/1995 (JP) .
8-63149 3/1996 (JP) .
10-149154 6/1998 (JP) .

* cited by examiner

*Primary Examiner*—Jeffrey Donels
(74) *Attorney, Agent, or Firm*—Morrison & Foerster

(57) ABSTRACT

An acoustic piano is equipped with a shank stopper moved into and out of trajectories of hammer assemblies and a change-over mechanism for changing the shank stopper, and the change-over mechanism has a pedal, a transmitter connected to the pedal and another transmitter held in contact with the transmitter for transmitting force exerted on the pedal to the shank stopper, wherein the transmitters are only restricted in the direction to transmit the force from the pedal to the shank stopper so that the transmitters are independently disassembled and regulable.

13 Claims, 11 Drawing Sheets

AR405

KEYBOARD MUSICAL INSTRUMENT EQUIPPED WITH PARTIALLY REPAIREABLE CHANGE-OVER MECHANISM FOR CHANGING HAMMER STOPPER

FIELD OF THE INVENTION

This invention relates to a keyboard musical instrument and, more particularly, to a keyboard musical instrument with a silent system for playing a passage on a keyboard without acoustic tones.

DESCRIPTION OF THE RELATED ART

The keyboard musical instrument is fabricated on the basis of an acoustic piano, and equipped with a silent system and an electronic sound system. The silent system has a hammer stopper changed between a free position and a blocking position. While a pianist is playing a tune on the keyboard, the hammers rebound on the hammer stopper in the blocking position before striking the music strings, and the music strings do not vibrate. The electronic sound system detects the key motions, and generates electronic sounds instead of the acoustic tones. When the silent system is changed to the free position, the hammer stopper is moved out of the trajectories of the hammers, and the hammers are allowed to selectively strike the associated music strings for generating the acoustic tones.

A shank stopper is a kind of the hammer stopper, and is popular with the actual products. The shank stopper laterally extends between the music strings and the hammer shanks, and, accordingly, is shared between the hammers. While a hammer is being driven for rotation toward the associated music string, the hammer shank is brought into contact with the shank stopper, and rebounds thereon. The shank stopper is, by way of example, connected through a wire to a grip or a pedal. A suitable converting member may be connected between the wire and the shank stopper so as to convert reciprocal motion of the wire to rotation of the shank stopper between the free position and the blocking position.

A problem is encountered in the prior art silent system in that workmen feel the installation inside the acoustic piano and the maintenance work time-consuming. This is because of the fact that the plural independent parts are assembled into the prior art hammer stopper. While workmen are assembling the plural independent parts such as the shank stopper, the converting member, the wire and the pedal/grip into the prior art hammer stopper inside the acoustic piano, the workmen connect the independent parts to one another in a predetermined sequence, and regulate the play and gap between the parts. When a workman replaces one of the parts to new one, the workman disassembles the prior art hammer stopper, replaces the part with new one, assembles them into the prior art hammer stopper, again, and regulates the play and gap between the parts. Thus, the installation and the maintenance work are time-consuming.

SUMMARY OF THE INVENTION

It is therefore an important object of the present invention to provide a keyboard musical instrument with a silent system, which is easily installed and maintenance work is simple.

To accomplish the object, the present invention proposes to restrict a contact between a first transmitter and a second transmitter in a direction to transmit a force.

In accordance with one aspect of the present invention, there is provided a keyboard musical instrument comprising an acoustic keyboard including plural keys selectively depressed by a player, plural music strings respectively associated with the plural keys and plural strikers driven by depressing the plural keys for striking the associated music strings and a silent system including a stopper moved between a free position and a blocking position so that the plural strikers strike the plural music strings without any interruption thereof at the free position and rebound thereon at the blocking position before striking the plural music strings and a change-over mechanism having a first transmitter connected to the stopper for changing the stopper between the free position and the blocking position and a second transmitter held in contact with the first transmitter without any restriction in a first direction for transmitting a force to the first transmitter in a second direction different from the first direction.

BRIEF DESCRIPTION OF THE DRAWINGS

The features and advantages of the keyboard musical instrument will be more clearly understood from the following description taken in conjunction with the accompanying drawings in which.

DESCRIPTION OF THE PREFERRED EMBODIMENTS

First Embodiment

Figure 1:
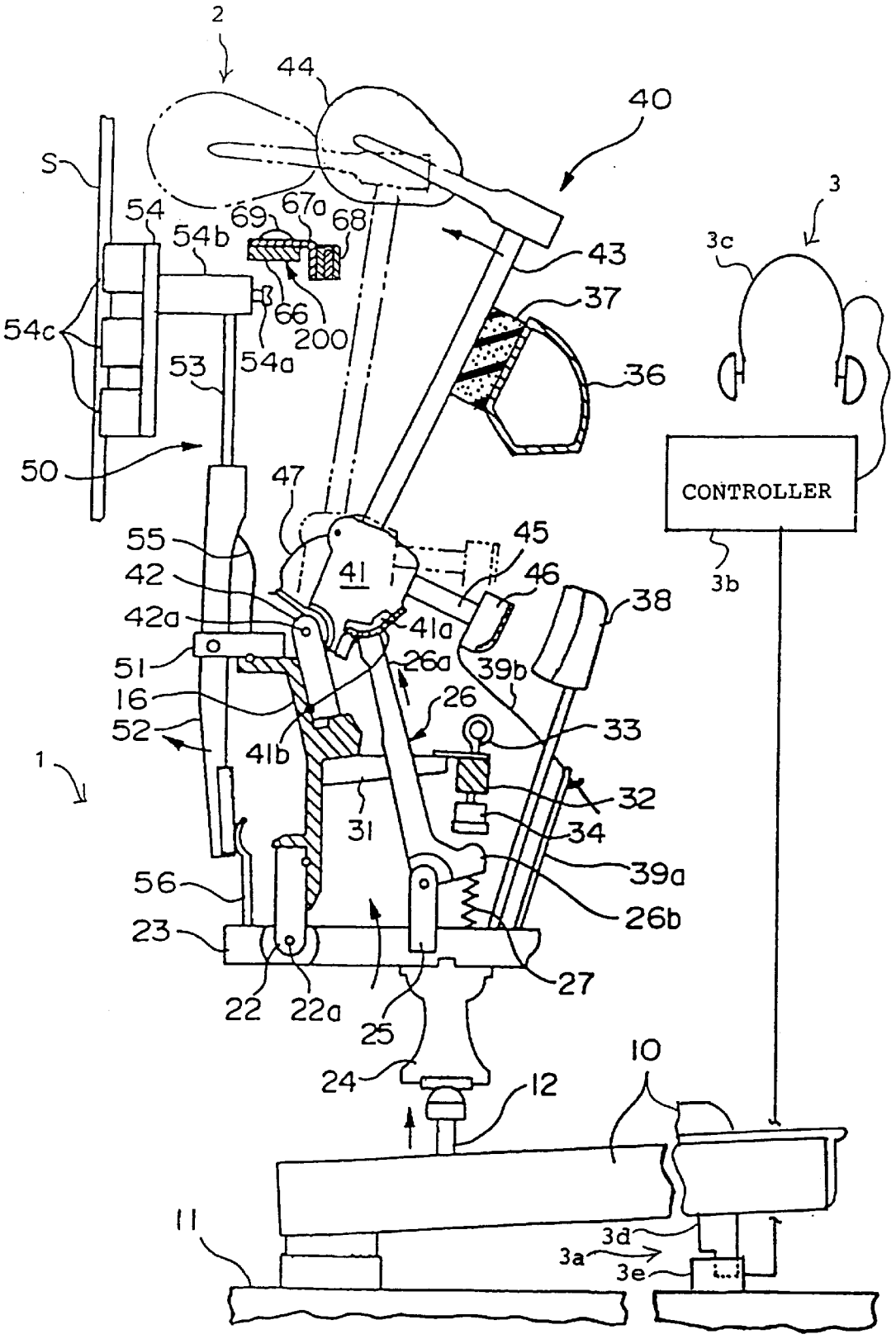
FIG. 1 is a side view showing an essential part of a keyboard musical instrument according to the present invention.

Referring to FIG. 1 of the drawings, a keyboard musical instrument embodying the present invention largely comprises an acoustic piano 1, a silent system 2 and an electronic sound generating system 3. Although an upright piano is used as the acoustic piano 1 in this instance, a grand piano is available for the keyboard musical instrument. In the following description, term "front" is used for a position closer to a pianist who is playing a passage on the acoustic piano than a "rear" position. A direction between a front position and a corresponding rear position is referred to as "fore-and-aft direction", and a lateral direction is perpendicular to the fore-and-aft direction.

The acoustic piano 1 comprises keyboard 4 and action mechanisms 5 linked with the keyboard 4. Black keys 10 and white keys 10 form the keyboard 4, and are laid on the well-known pattern. The keyboard 4 is mounted on a key bed 11, which forms a part of a piano case. Capstan screws 12 project from the rear end portions of the black/white keys 10. The action mechanisms 5 are associated with the black/white keys 10, respectively, and are actuated by the associated black/white keys 10.

A center rail 16 laterally extends over the rear end portions of the black/white keys 10, and are supported by means of action brackets (not shown) on the key bend 11. The action mechanisms 5 are connected to the center rail 16 at intervals. The action mechanisms 5 are similar in structure to one another, and the structure of the action mechanism 5 is described hereinlater in detail.

The action mechanism 5 includes a whippen flange 22, a whippen 22 and a whippen heel 24. The whippen flange 22 is bolted to the center rail 16, and the whippen 23 is rotatably connected to the lower end portion of the whippen flange by means of a center pin 22*a*. The center pin 22*a* is closer to the rear end surface of the whippen than the front end surface thereof. The whippen heel 24 is attached to the lower surface of the whippen 23, and is farther from the rear end surface than the center pin 22*a*. The capstan screw 12 is held in contact with the whippen heel 24 as shown. When a pianist depresses the front end portion of the associated black/white key 10, the capstan screw 12 upwardly pushes the whippen heel 24, and gives rise to rotation of the whippen 23 in the counter clockwise direction around the whippen flange 22.

The action mechanism 5 further includes a jack flange 25, a jack 26 and a jack string 27. The jack flange 25 is upright from the whippen 23, and is farther from the rear end surface than the center pin 22*a*. The jack is rotatably supported by the jack flange 25, and the jack spring 27 urges the jack 26 in the counter clockwise direction at all times. The jack 26 is shaped in an L-letter configuration, and the long portion 26*a* and the short portion 26*b* are referred to as "leg" and "tow", respectively.

The action mechanism 5 further includes fork screws 31, a regulating rail 32, a regulating screw 33 and a regulating button 34. The fork screws 31 project from the center rail 16, and the regulating rail 32 is connected to the front end portions of the fork screws 31. Thus, the regulating rail 32 laterally extends over the tows 26*b* of the jacks 26. The regulating button 34 is connected through the regulating screw 33 to the regulating button 34, and the tow 26*b* is opposed to the lower surface of the regulating button 34. The gap between the tow 26*b* and the regulating button 34 is regulable by twisting the regulating screw 33.

While the player is depressing the black/white key 10, the whippen 23 is rotated around the whippen flange 22 in the counter clockwise direction, and the jack 26 is also rotated around the whippen flange 22 without relative rotation around the jack flange 25. The tow 26*b* is getting closer and closer to the regulating button 34, and is brought into contact with the regulating button 34. Then, the jack 26 turns around the jack flange 25 in the clockwise direction against the elastic force of the jack string 27, and escapes.

A hammer rail 36 laterally extends over the regulating rail 32, and a hammer rail cloth 37 is attached to the rear surface of the regulating rail 32. The action mechanism 5 further includes a back check 38, a bridle wire 39*a* and a bridle tape 39*b*. The back check 38 is maintained over the front end portion of the whippen 23, and the bridle wire 39*a* upwardly projects from the front end portion of the whippen 23. The back check 38 and the bridle tape 39*b* will be hereinbelow described.

The acoustic piano 1 further comprises hammer assemblies 40 and damper mechanisms 50 and sets of strings S. The hammer assemblies 40 are associated with the action mechanisms 5, respectively, and are driven for rotation by the jacks 26 of the associated action mechanisms 5 at the escape. The damper mechanisms 50 are also associated with the action mechanisms 5, and absorb the vibrations of the associated sets of strings S. When the associated black/white keys 10 are staying in the rest positions, the damper mechanisms 50 do not allow the associated sets of strings S to vibrate, and any acoustic tone is not generated from the sets of strings S. The damper mechanism 50 allows the associated set of strings S at a certain key position on the way toward the end position. When the associated black/white key 10 passes the certain key position, the jack 26 is rotated around the whippen flange 22 without the relative rotation around the jack flange 25, and has not escaped from the hammer assembly 40, yet. In other words, the jack 26 escapes from the associated hammer assembly 40 after the damper mechanism 50 has allowed the set of strings S to vibrate. For this reason, when the hammer assembly 40 strikes the set of strings S, the strings S vibrate so as to generate the acoustic tone. When the pianist releases the depressed black/white key 10, the whippen 23 is rotated around the whippen flange 22 in the clockwise direction, and the damper mechanism 50 prohibits the associated set of strings S from the vibrations.

The hammer assemblies 40 are similar in structure to one another, and the structure is described hereinbelow in detail. The hammer assembly 40 includes a hammer butt 41, a butt flange 42, a hammer shank 43 and a hammer head 44. The butt flange 42 is fixed to the front surface of the center rail 16, and the hammer butt 41 is rotatably connected to the butt flange 42 by means of a center pin 42*a*. The hammer shank 43 upwardly projects from the hammer butt 41, and the hammer head 44 is attached to the leading end of the hammer shank 43. The hammer head 44 is directed to the associated set of strings S.

The hammer assembly 40 further comprises a catcher shank 45, a catcher 46 and a butt spring 47. The catcher shank 45 projects from the hammer butt 41 in the perpendicular direction to the hammer shank 43, and the catcher 46 is attached to the leading end of the catcher shank 46. The butt spring 47 is inserted between the butt flange 42 and the hammer butt 41, and urges the hammer assembly 40 to turn in the clockwise direction. For this reason, while the associated black/white key 10 is staying in the rest position, the hammer shank 43 is held in contact with the hammer rail cloth 37 due to the elastic force of the butt spring 47. The catcher 45 is connected through the bridle tape 39*b* to the bridle wire 39*a*, and the hammer assembly 40 is linked with the whippen 23 by means of the bridle tape 39*b* and the bridle wire 39*a*. When the hammer assemblies 40 rebound on the sets of strings S, the hammer assemblies 40 start the rotation in the clockwise direction. The catcher 46 is brought into contact with the back check 38. However, the hammer assemblies 40 do not strike the sets of strings S, again, because the bridle tapes 39*b* set a limit on the rebound.

A butt under felt 41*a* is attached to a lower surface of the hammer butt 41, and a butt skin 41*b* is laminated on the butt under felt 41*a*. The leading end surface of the leg 26*a* is held in contact with the butt skin 41*b* until the escape from the hammer butt 41. While a pianist is depressing the associated black/white key 10, the jack 26 turns around the whippen flange 22 in the counter clockwise direction, and pushes the butt skin 41*b*. As a result, the jack 26 gives rise to rotation of the hammer assembly 40 in the counter clockwise direction around the butt flange 42 until the escape. When the jack 26 escapes from the hammer butt 41, the hammer assembly 40 starts the free rotation toward the associated set of strings S.

The damper mechanisms 50 are similar in structure to one another. Each of the damper mechanisms 50 includes a damper flange 51, a damper lever 52, a damper wire 53, a damper head 54, a damper spring 55 and a damper spoon 56. The damper flange 51 is fixed to the center rail 16, and the damper lever 52 is rotatably connected to the damper flange 51 at an intermediate position thereof. The damper wire 53 upwardly projects from the damper lever 52, and the damper head 54 is attached to the leading end of the damper wire 53.

A damper screw 54*a* fixes a damper wood 54*b* to the damper wire 53, and damper felts 54*c* are attached to the rear surface of the damper wood 54*b*. The damper spring 55 urges the damper lever 52 in the counter clockwise direction at all times. The damper spoon 56 upwardly projects from the rear end portion of the whippen 23, and is held in contact with the damper lever 52. While the associated black/white key 10 is staying in the rest position, the whippen 23 is substantially horizontal, and the damper spoon 56 allows the damper spring 55 to hold the damper felts 54*c* into contact with the associated set of strings S. When a pianist depresses the black/white key 10, the whippen 23 is rotated in the counter clockwise direction, and the damper spoon 56 backwardly inclines. The damper spoon 56 pushes the damper lever 52, and gives rise to rotation in the clockwise direction around the damper flange 51. As a result, the damper felts 54*c* are spaced from the associated set of strings S. When the pianist releases the depressed black/white key 10, the whippen 23 is recovered to the horizontal position, and the damper spring 55 brings the damper felts 54*c* into contact with the associated set of springs S, again. While the damper felts 54*c* are being spaced from the associated set of strings S, the hammer assembly 40 strikes the sets of strings S, and the sets of strings S generate an acoustic tone through the vibrations. However, when the damper felts 54*c* are brought into contact with the set of strings S, the damper felts 54*c* absorb the vibrations, and the acoustic tone is decayed.

The silent system 2 includes a shank stopper 200 and a change-over mechanism 350 (see FIGS. 2 to 8). The shank stopper 200 is provided between the hammer shanks 43 and the sets of strings S, and a pianist changes the silent system 200 between the free position and the blocking position by means of the change-over mechanism 350. When the pianist changes the silent system 2 to the blocking position, the shank stopper 200 is frontwardly moved, and is positioned on the trajectories of the hammer shanks 43. When the pianist changes the silent system 2 to the free position, the shank stopper 200 is backwardly moved, and is positioned out of the trajectories of the hammer shanks 43. Thus, the shank stopper 200 is bi-directionally moved in the fore-and-aft direction.

Figure 2:
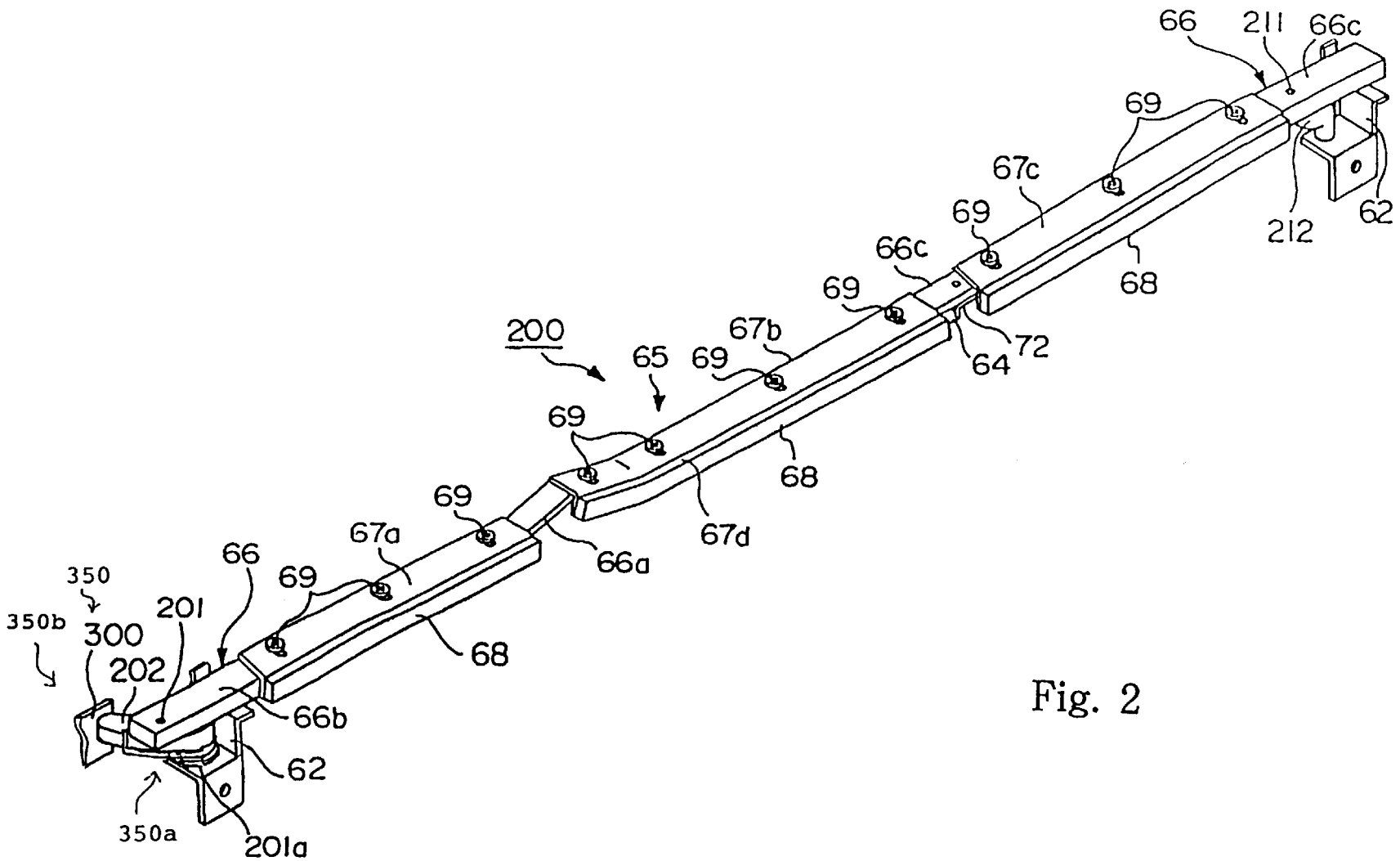
FIG. 2 is a perspective view showing a shank stopper incorporated in a silent system of the keyboard musical instrument.

The shank stopper 200 is illustrated in FIG. 2 in detail. The shank stopper 200 includes a rail base 66, stopper rail segments 67*a*/67*b*/67*c* and impact absorbers 68. The rail base 66 is as long as the array of the hammer assemblies 40, and has a sloop 66*a* between a short portion 66*b* and a long portion 66*c*. The long portion 66*c* is partially raised, and is connected through the sloop 66*a* to the short portion 66*b*. The stopper rail segments 67*a*/67*b*/67*c* are assigned to the lower pitched part, the middle pitched part and the higher pitched part, respectively, and the impact absorbers 68 are attached to the front surfaces of the stopper rail segments 67*a*/67*b*/67*c*.

The stopper rail segment 67*a* is fixed to the short portion 66*b* by means of bolts 69, and the other stopper rail segments 67*b*/67*c* are bolted to the long portion 66*c* by means of bolts 69. As will be better seen in FIGS. 3A and 3B, the stopper rail segments 67*a*/67*b*/67*c* have an L-letter shape, and slots 70 are formed in the stopper rail segments 67*a*/67*b*/67*c*. The slots 70 are open at the rear surfaces of the stopper rail segments 67*a*/67*b*/67*c*, and are elongated in the fore-and-aft direction. The bolts 68 pass the slots 70, and are screwed into threaded holes formed in the rail base 66. This means that the stopper rail segments 67*a*/67*b*/67*c* are independently regulable with respect to the rail base 66. In detail, an operator loosens the bolts 69, and makes the stopper rail segments 67*a*/67*b*/67*c* slidable on the rail base 66. When the stopper rail segments 67*a*/67*b*/67*c* are adjusted to appropriate positions, respectively, the operator screws the bolts 69 into the stopper rail segments 67*a*/67*b*/67*c*, and the bolts 69 press the stopper rail segments 67*a*/67*b*/67*c* against the rail base 66. Thus, each of the stopper rail segments 67*a*/67*b*/67*c* and, accordingly, the impact absorber 68 are adjusted to a position appropriate to the hammer assemblies 40 assigned to one of the pitched parts independently of the other stopper rail segments and the impact absorbers 68 attached thereto. The appropriate position of each impact absorber 68 is between a position of the hammer shank 43 at the escape and another position of the hammer shank 43 at the strike against the set of strings S. The distance between the two positions is short, and the pair of positions is not constant between the groups of the hammer assemblies 40 respectively assigned to the three pitched parts. If the impact absorbers 68 are regulated to appropriate thickness, the irregularity may be taken up. However, the shank stopper 200 requires three kinds of impact absorber 68 different in thickness, and the three kinds of impact absorbers 68 increase the number of the component parts. The stopper rail segments 67*a*/67*b*/67*c* require only one kind of impact absorbers 68, and reduce the number of component parts of the silent system.

The impact absorbers 68 have a laminated structure, and a resilient layer is covered with a protective layer. The resilient layer may be formed of urethane foam or felt, and the protective layer may be formed of artificial leather. As described hereinbefore, the left part of the long portion 67*b* is upwardly bent, and is connected through the sloop 66*a* to the short portion 67*a*. The stopper rail segment 67*b* has a left part 67*d* bent from the remaining part, and, accordingly, the impact absorber 68 is partially bent toward the sloop 66*a*.

The sets of strings S are stretched over a frame (not shown), and are divided into two groups. The first group is assigned to the lower pitched part, and the second group is assigned to the middle/higher pitched parts. The first group obliquely extends from the upper end of the left side toward the lower end of the right side, and the second group extends from the upper end of the right side toward the lower end of the left side. Accordingly, the sets of strings S for the lower pitched group cross several sets of strings S for the middle pitched part. In order to dodge the sets of strings S for the higher pitched part, the hammer heads 44 and the damper heads 54*b* for the several sets of strings S are located to be higher than those for the other sets of the strings S in the same part. This is the reason why the rail base 66, the stopper rail segment 67*b* and the impact absorber 68 are upwardly bent. The hammer shanks 43 for the several sets of strings S rebound on the oblique portion of the impact absorber 68 attached to the stopper rail segment 67*b* without undesirable interference between the impact absorber 68 and the damper mechanisms 50.

The change-over mechanism 350 is broken down into two transmitters 350*a*/350*b*, a contact keeper 201*a*, a limiter 350*c* and a muffler pedal 402. The transmitter 350*a* is connected to the shank stopper 200, and the other transmitter 350*b* is connected to the muffler pedal 402. The transmitter

350*a* is held in contact with the other transmitter 350*b* by means of the contact keeper 201*a*. In this instance, the contact keeper is implemented by a torsion spring 201*a*. When a pianist steps on the muffler pedal 402, the force is transmitted through the transmitters 350*a*/350*b* to the shank stopper 200, and the shank stopper 200 is changed between the free position and the blocking position. The limiter 50*c* sets a limit on the trajectory of the transmitter 350*a* and, accordingly, the shank stopper 200 so as to exactly position the shank stopper 200 at the blocking position and the free position.

Figure 3B:
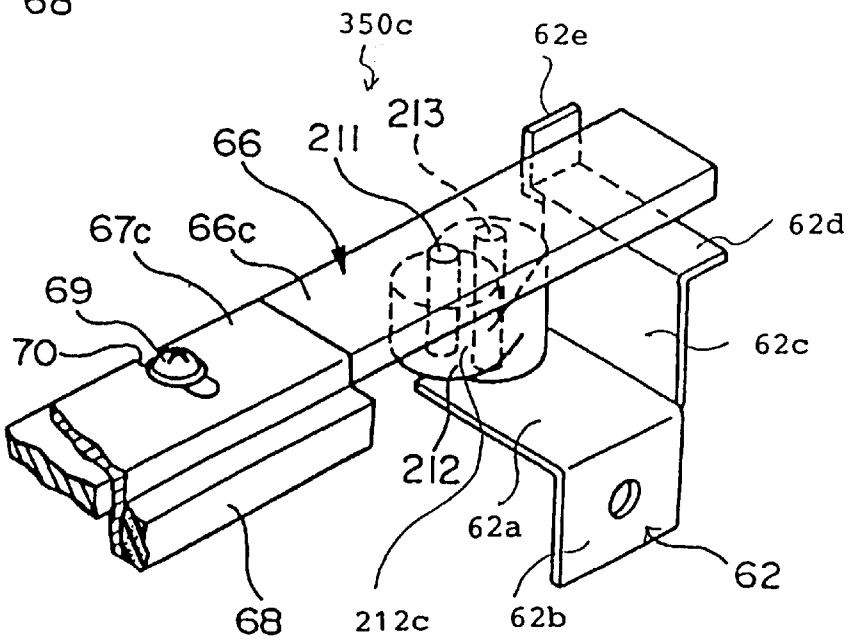
FIGS. 3A and 3B are perspective views showing a change-over mechanism incorporated in the silent system.
Figure 3A:
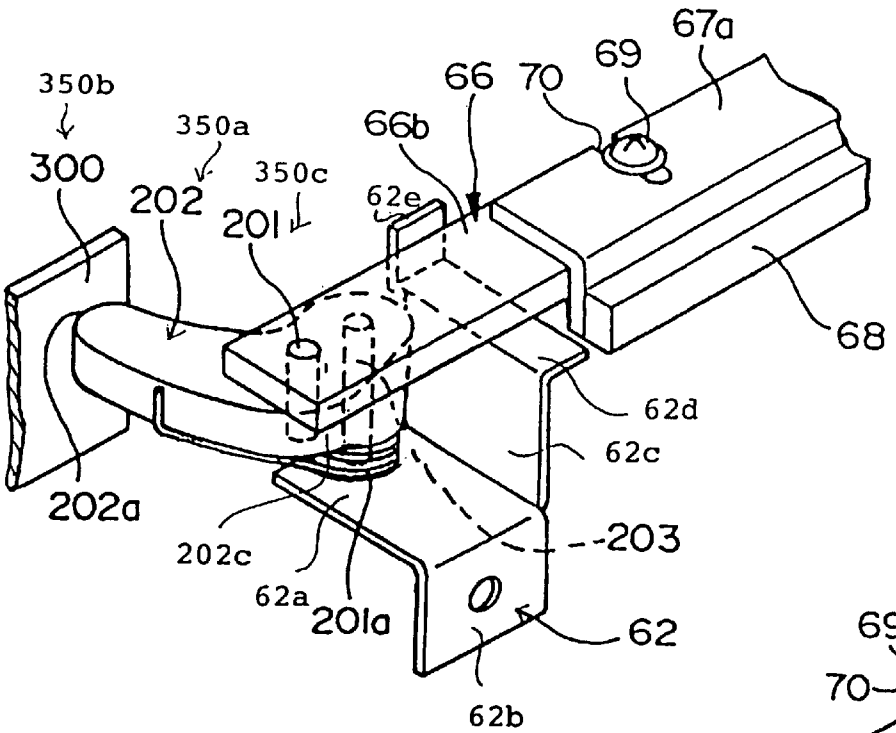

The transmitter 350*a*, the contact keeper 201*a* and the limiter 350*c* are shown in FIGS. 3A and 3B in detail. Brackets 62 are fixed to the action brackets (not shown). The bracket 62 has a base portion 62*a* horizontal to the key bed 11, a front wall portion 62*b* downwardly extending from the front end of the base portion 62*a*, a side wall portion 62*c* upwardly extending from a side of the base portion 62*a*, a guide portion 62*d* laterally projecting from the upper end of the side wall portion and a stopper portion 62*e* upwardly projecting from the rear end of the guide portion 62*d*. Both side portions of the rail base 66 extend over the guide portions 62*d*, and the rail base 66 is moved on or over the guide portions 82. The stopper portions 62*e* do not allow the shank stopper 200 to be backwardly moved therebeyond. Thus, the stopper portions 62*e* form parts of the limiter 350*c*.

The transmitter 350*a* includes pins 203/213 upright on the base portions 62*a*, an arm member 202 rotatably supported by the pin 203, an idler 212 also rotatably supported by the other pin 213 and pins 201/211 respectively fixed to the arm member/idler 202/212. The pins 201/211 are rotatably connected to both end portions of the rail base 66. The arm member 202 has a generally L-letter shape, and the pin 203 is received in a hole formed in the short portion of the arm member 202. The torsion spring 201*a* is wound around the pin 203, and is engaged with the long portion of the arm member 202. The torsion spring 201*a* urges the arm member 202 in the clockwise direction at all times, and keeps the arm member 202 in contact with the transmitter 300 at the leading end 202*a* of the long portion thereof. Thus, the arm member 202 is not restrained to the transmitter 350*a*, but is only held in contact with the transmitter 350*a* due to the elastic force of the torsion spring 201*a*.

The pin 201 is spaced from the pin 203, and is spaced from the pin 203 by a predetermined distance. The distance between the pin 203 and a contact surface 202*c* is maximized. The contact surface 202*c* is brought into contact with the side wall portion 62*c*, and sets a limit on the rotation of the shank stopper 200 in the counter clockwise direction. The idler 212 is shaped into an elliptical column, and the pin 211 is spaced from the pin 213 by the predetermined distance. The relative position between the pins 201 and 203 is same as the relative position between the pins 211 and 213. The distance between the pin 211 and a contact surface 212*c* is maximized. The contact surface 212*c* is brought into contact with the side wall portion 62*c*, and sets the limit on the rotation of the shank stopper 200 in the counter clockwise direction together with the contact surface 202*c*. Thus, the contact surfaces 202*c*/212*c* and the side wall portions 62*c* set a limit on the motion of the shank stopper 200, and form parts of the limiter 350*c*. The virtual lines between the pins 201/211 and the pins 203/213, the virtual line between the pins 201 and 211 and the virtual line between the pins 203 and 213 form a parallel link mechanism, which is rotatable around the pins 203/213.

Figure 4A:
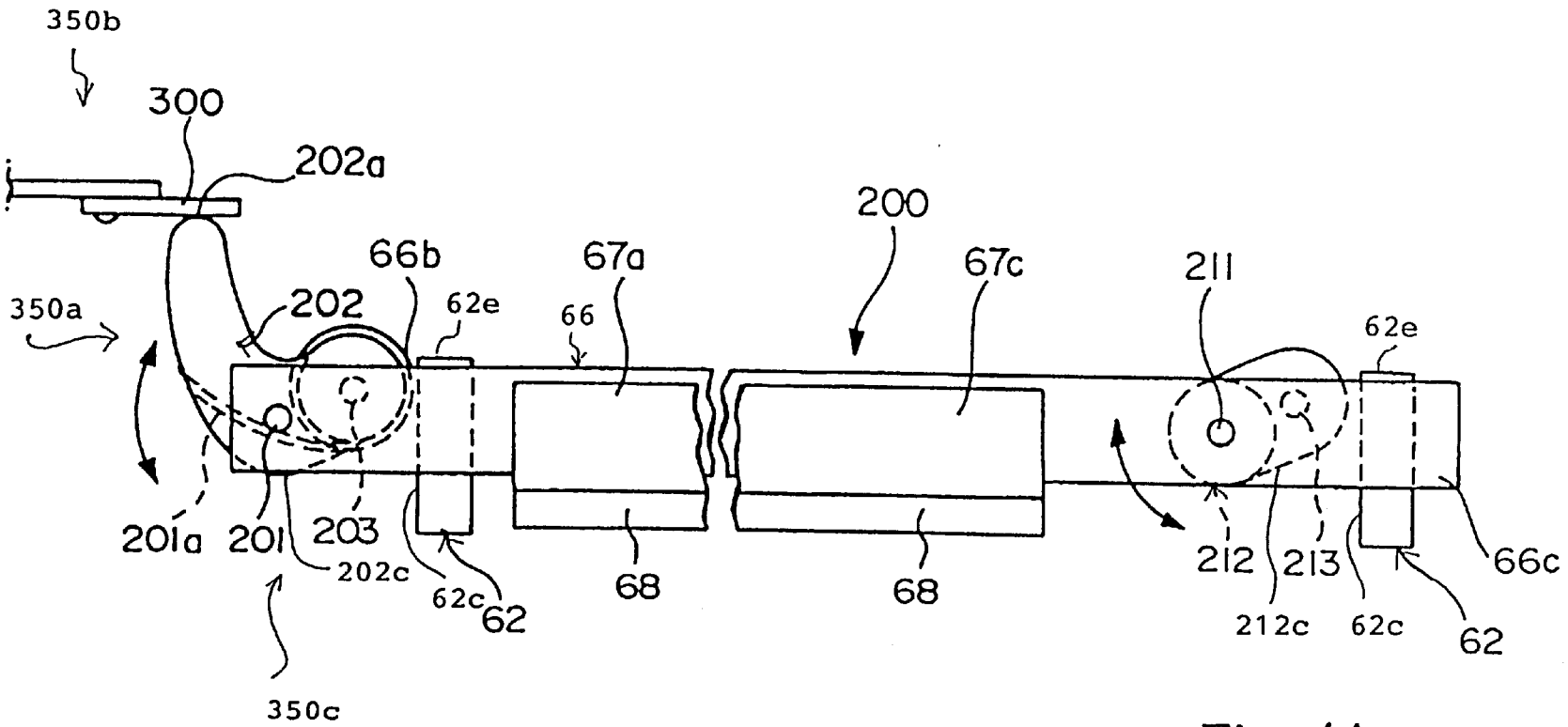
FIGS. 4A and 4B are plane views showing the shank stopper in a free position and a blocking position, respectively.

While the transmitter 350 does not exert any force on the arm member 202, the torsion spring 201*a* urges the arm member 202 in the clockwise direction, and the arm member 202 and the idler 212 press the rail base 66 against the stopper portions 62*e* as shown in FIG. 4A. The impact absorbers 68 are out of the trajectories of the hammer shanks 43, and the shank stopper 200 is at the free position.

When the transmitter 350 exerts force on the arm member 202 in the direction toward the front, the arm member 202 and the idler 212 are driven for rotation in the counter clockwise direction against the elastic force of the torsion spring 201*a*. The arm member/idler 202/212 and, accordingly, the shank stopper 200 are rotated around the pins 203/213 as indicated by real lines in FIG. 4B. The impact absorbers 68 are moved into the trajectories of the hammer shanks 43, and the shank stopper 200 is changed to the blocking position. Thus, the arm member 202 and the idler 212 are rotated on virtual planes in parallel to the upper/lower surfaces of the rail base 66. Although the force is transmitted to the arm member 202 on the left side of the shank stopper 200, any twisting moment is not exerted on the shank stopper 200, and the impact absorbers 68 are surely moved to the most appropriate blocking position without any twist.

Figure 4B:
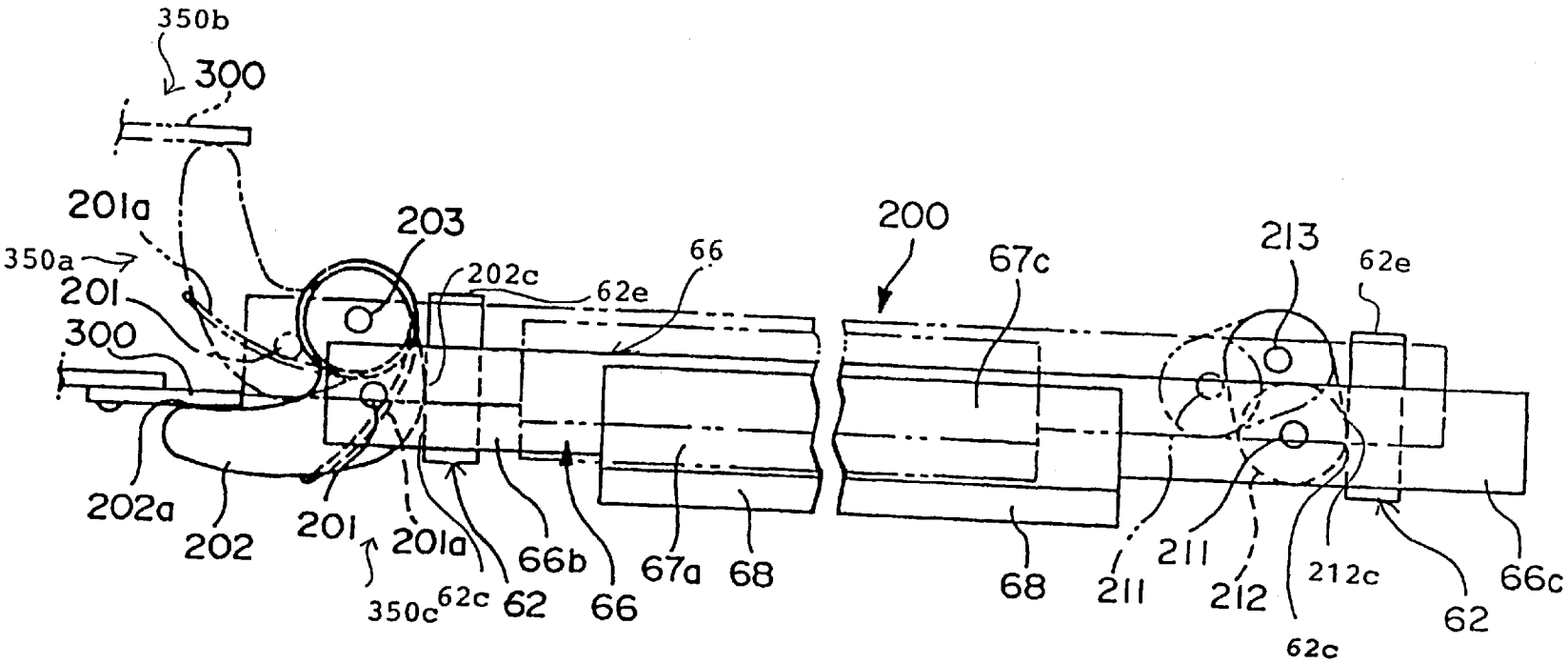

The pin 201 is positioned on the left side of the pin 203 in the free position and on the right side of the pin 203 in the blocking position (see FIGS. 4A and 4B). Similarly, the pin 211 is positioned on the left side of the pin 213 in the free position and on the right side of the pin 213 in the blocking position. The relative position between the pins 201/211 and the pins 203/213 is desirable, because the rebound on the impact absorbers 68 does not result in unintentional change from the blocking position to the free position. In detail, when a pianist wants to change the shank stopper 200 from the blocking position to the free position, the pianist exerts moment on the arm member 202 so as to give rise to rotation of the arm member 202 in the clockwise direction around the pin 203. However, when the hammer shank 43 rebounds on the impact absorber 68, the impact generates the moment in the opposite direction, and the arm member 202 is driven for rotation in the counter clockwise direction around the pin 203. The moment due to the impact is opposite in direction to the moment to be required for the change to the free position. Moreover, the contact surfaces 202*c*/212*c* are held in contact with the side wall portions 62*c*, and set the limit on the rotation of the shank stopper 200 in the counter clockwise direction. Thus, the shank stopper 200 is never unintentionally changed to the free position. The impact force is transferred from the shank stopper 200 through the contact between the contact surfaces 202*c*/212*c* and the side wall portions 62*c* to the brackets 62, and the shank stopper 200 never vibrates.

The other transmitter 350*b* is illustrated in FIGS. 5, 6, 7 and 8 in detail. The other transmitter 350*b* is supported by a side board 304 by means of bolts 301, and the muffler pedal 402 is connected through the transmitter 350*b* (see FIG. 8) to the transmitter 350*a*. In this instance, the muffler pedal 402 is located between a soft pedal 401 and a damper pedal 403. The soft pedal 401 and the damper pedal 403 are respectively connected to a soft pedal mechanism 404 and a damper pedal mechanism 406. The soft pedal mechanism 404 and the damper pedal mechanism 406 are well known to skilled person, and no further description is incorporated therein. The side board 304 forms another part of the piano case.

The transmitter 350*b* includes a sliding box 303, a shaft 305 and a base plate 306. The base plate 306 is fixed to the side board 304 by means of the bolts 301, and has a pair of bearing portions 306*a*. The bearing portions 306*a* are spaced from each other in the fore-and-aft direction, and the shaft 305 is supported at both ends thereof by the bearing portions 306*a*. The sliding box 303 has through-holes, and the shaft 305 passes the through-holes. The sliding box 303 is slidable along the shaft 305 in the fore-and-aft direction.

The transmitter 350*b* further includes a supporting block 301 and a pusher 300. Plates 302*a*/302*b* form in combination the supporting block 301. The plate 302*a* has a projection 302*c* downwardly projecting from the lower end surface of the plate 302*a*, and is fixed to the sliding box 303 by means of bolts 301. The plate 302*a* has an L-letter shape, and is fixed to the plate 302*b*. The plate 302*b* projects from the sliding box 303, and is inwardly bent. The pusher 300 is formed with holes 300*a*, and the holes 300*a* are laterally elongated. The pusher 300 is connected through the holes 300*a* to the plate 302*a* by means of bolts 301, and projects toward the hammer shank stopper 200. The elongated holes 300*a* are desirable, because an assembly worker regulates the pusher 300 to appropriate position with respect to the arm member 202. Thus, the pusher 300 is connected through the supporting block 301 to the sliding box 303, and, accordingly, is movable in the fore-and-aft direction. When the sliding box 303 is frontwardly moved along the shaft 305, the pusher 300 gives rise to the rotation of the arm member 202 against the elastic force of the torsion spring 201*a*, and the hammer shank 200 is changed to the blocking position.

The transmitter 350*b* further includes an arm member 308 swingably supported by the base plate 306 by means of a pin 309, a connecting rod 307 connected between the projection 302*c* and the lower portion of the arm member 308 and a spring stretched between the connecting rod 307 and an anchor 311. The connecting rod 307 has end portions 307*a*/307*b* bent toward the side board 304, and the end portions 307*a*/307*b* are rotatably connected to the projection 302*a* and the arm member 308, respectively. The anchor 311 is fixed to the side board 304, and the spring 310 rearwardly urges the supporting block 302 and, accordingly, the sliding box 303 at all times. The elastic force is transmitted through the lower portion of the arm member 308, and the moment urges the arm member 308 in the counter clockwise direction at all times. As a result, while any force is not exerted on the arm member 308, the pusher 300 is spaced from the bearing portion 306*a* due to the elastic force of the spring 310, and the torsion spring 201*a* keeps the arm member 202 held in contact with the pusher 300.

The transmitter 350*b* further includes muffler links 400/410/412 and link levers 411/413. A notch 308*a* is formed in the arm member 308, and is rearwardly spaced from the pin 309. The muffler link 400 is engaged with the arm member 308 at the notch 308*a*. When the muffler link 400 is pulled down, the counter moment is exerted on the arm member 308, and gives rise to rotation in the clockwise direction against the moment due to the elastic force (see FIG. 7). While the muffler link 400 is not pulled down, the muffler link 400 restricts the arm member 308, and determines the position of the arm member 308 and, accordingly, the position of the pusher 300 (see FIG. 5).

The link levers 411/413 are swingably supported by the piano case at intermediate portions thereof. The link lever 413 is located under the base plate 306, and the other link lever 411 is laterally spaced from the link lever 413. The link lever 413 is rotatably connected at one end thereof to the lower end portion of the muffler link 400 and at the other end thereof to one end portion of the muffler link 412. The muffler link 412 laterally extends, and the other link lever 411 is rotatably connected at one end thereof to the other end of the muffler link 412 and at the other end thereof to one end of the muffler link 410. The muffler link 410 vertically extends from the other end of the link lever 411 to the muffler pedal 402. Though not shown in the drawings, a ratchet wheel is connected to the muffler pedal 402, and a pawl is provided in association with the ratchet wheel. The pawl is engaged with the ratchet wheel, and the pawl and the ratchet wheel keep the muffler pedal 402 depressed. When the pawl is released from the ratchet wheel, a return spring (not shown) allows the muffler pedal 402 to return to the rest position.

Figure 5:
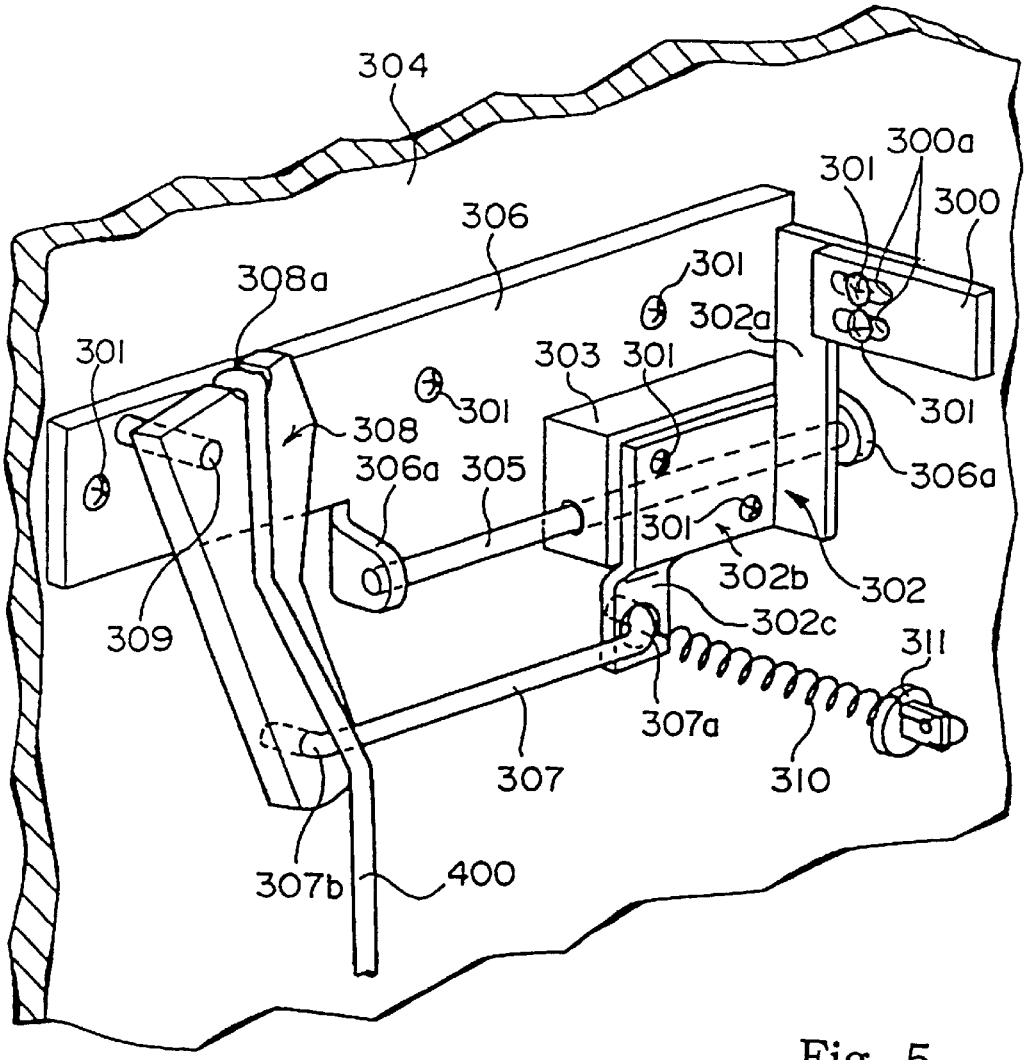
FIG. 5 is a perspective view showing the change-over mechanism in the free position.
Figure 6:
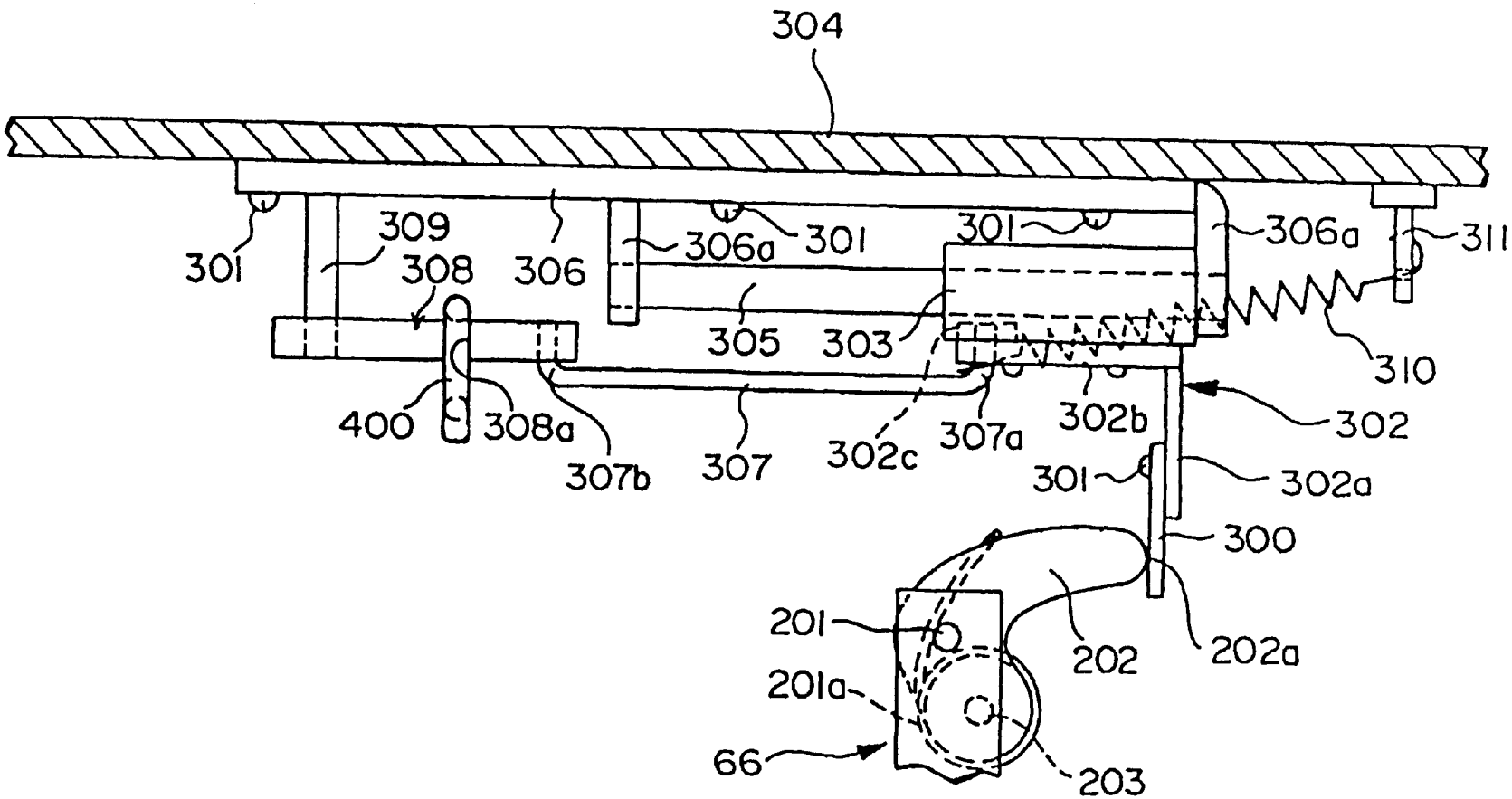
FIG. 6 is a plane view showing the change-over mechanism.
Figure 7:
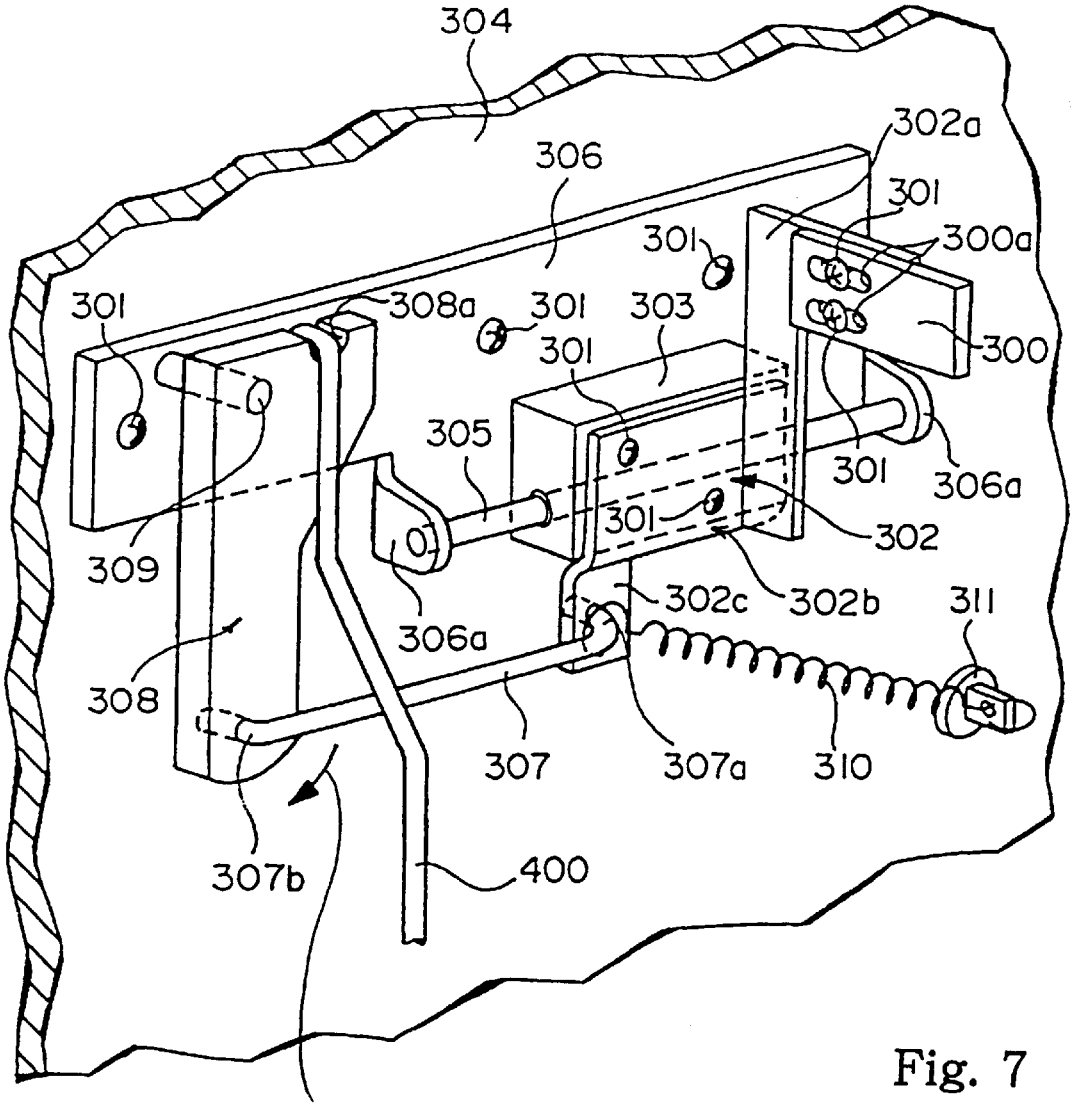
FIG. 7 is a perspective view showing the change-over mechanism in the blocking position.
Figure 8:
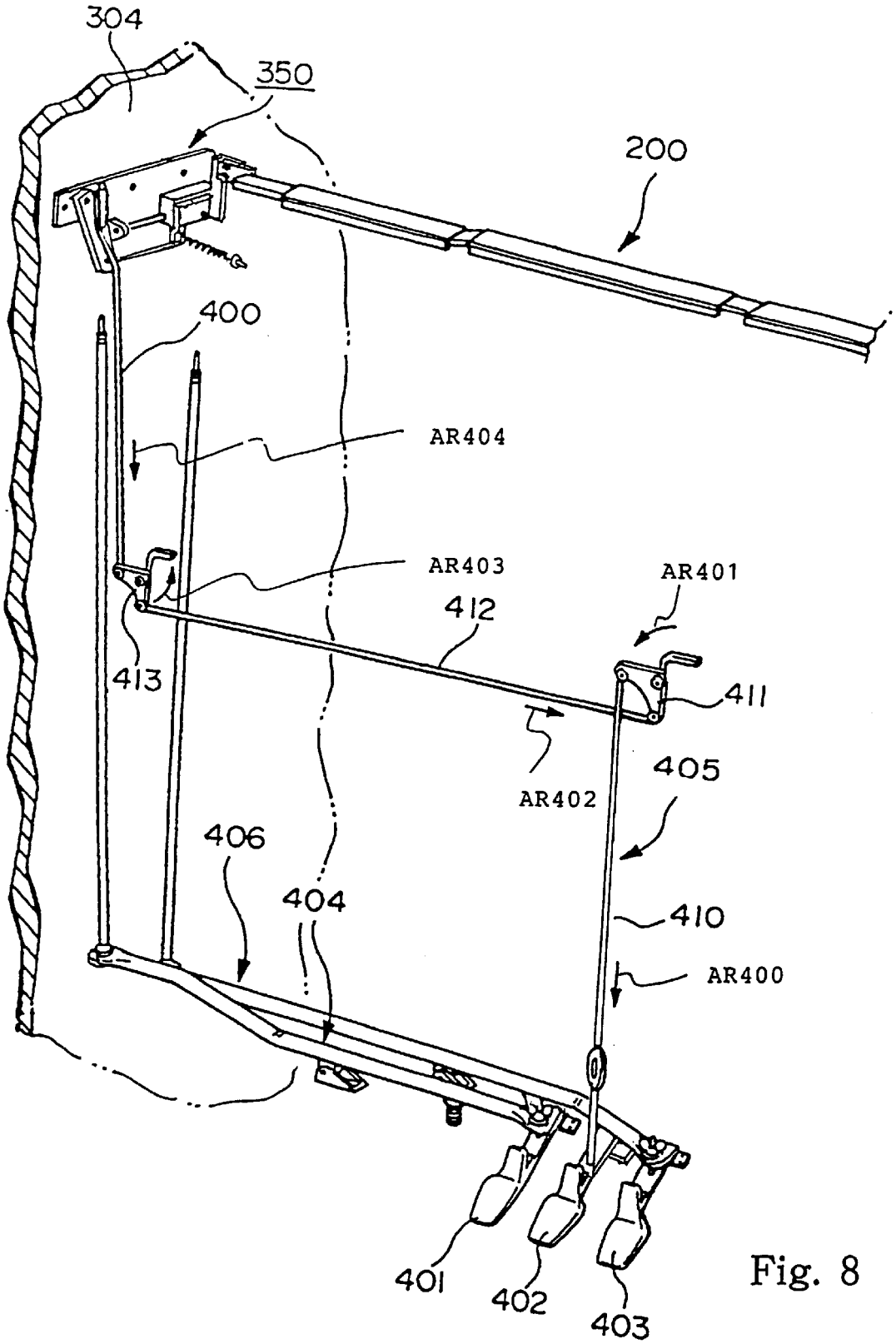
FIG. 8 is a perspective view showing the silent system.

A pianist changes the shank stopper 200 between the free position and the blocking position as follows. While the pianist keeps the muffler pedal 402 at the rest position, the muffler link 400 does not exert any force on the arm member 308, and permits the spring 310 to incline the arm member 308 as shown in FIG. 5. The spring 310 keeps the sliding box 303 and, accordingly, the pusher 300 at the rear end positions, and the torsion spring 201*a* keeps the arm member 202 held in contact with the pusher 300. As a result, the arm member 202 keeps the rail base 66 retracted as shown in FIG. 4A, and the impact absorbers 68 are out of the trajectories of the hammer shanks 43.

The pianist is assumed to step on the muffler pedal 402, the muffler link 410 is pulled down as indicated by arrow AR400 (see FIG. 8), and gives rise to rotation of the link lever 411 in the counter clockwise direction as indicated by arrow AR401. The link lever 411 rightwardly pulls the muffler link 412 as indicated by arrow AR402, and gives rise to rotation of the link lever 413 in the counter clockwise direction as indicated by arrow AR403. The link lever 413 pulls down the muffler link 400 as indicated by arrow AR404, and gives rise to the rotation of the arm member 308.

The arm member 308 is driven for rotation in the clockwise direction as indicated by arrow AR405 (see FIG. 7), and frontwardly pulls the connecting rod 307 against the elastic force of the spring 310. As a result, the sliding box 303 and, accordingly, the pusher 300 are frontwardly moved along the shaft 305 (compare FIG. 5 with FIG. 7). The pusher 300 gives rise to the rotation of the arm member 202 around the pin 203 in the counter clockwise direction against the elastic force of the torsion spring 201*a*, and the rail base 66 is also rotated around the pins 203/213 in the counter clockwise direction (see FIG. 4B). This results in that the impact absorbers 68 are moved into the trajectories of the hammer shanks 43. Thus, the shank stopper 200 enters the blocking position. Even if the pianist leaves his foot from the muffler pedal 402, the ratchet wheel and the pawl keep the muffler pedal 402 depressed, and the change-over mechanism 350 maintains the shank stopper 200 in the blocking position.

When the pianist releases the pawl from the ratchet wheel, the return spring (not shown) permits the muffler pedal 402 to return to the rest position, and the muffler links 410/412/400 and the link levers 411/413 are moved in the opposite directions to the directions indicated by arrows AR400/AR402/AR404 and AR401/AR403. The counter moment is removed from the arm member 308, and the spring 310 causes the connecting rod 307 to pull the lower portion of the arm member 308 and push the supporting block 302 and, accordingly, the sliding box 303 rearwardly. The sliding box 303 rearwardly slides along the shaft 305, and positions the pusher to the rear end position as shown in FIG. 5. While the pusher 300 is being moved toward the rear end position, the torsion spring 201*a* continuously urging the arm member 202 to keep it held in contact with the pusher 300. The arm member 202 is driven for rotation around the pin 203 in the clockwise direction, and returns to the position shown in FIG. 4A. The rail base 66 is also rotated around the pins 203/213, and retracts the impact absorbers 68 from the trajectories of the hammer shanks 43. Thus, the change-over mechanism 350 changes the shank stopper 200 to the free position.

Turning back to FIG. 1, the electronic sound generating system 3 comprises key sensors 3*a*, a controller 3*b* and a sound system such as, for example, a headphone 3*c*. The key sensors 3*a* are provided on the key bed 11, and are respectively associated with the black/white keys 10. The key sensor 3*a* is implemented by the combination of a shutter plate 3*d* and photo-couplers 3*e*. The shutter plate 3*d* is attached to the lower surface of the associated black/white key 10, and the associated photo-couplers 3*e* are arranged along the trajectory of the shutter plate 3*d*.

A pianist is assumed to depress a black/white key 10. The black/white key 10 is moved from the rest position toward the end position, and sinks the shutter plate 3*d*. The shutter plate 3*d* sequentially intersects the optical beams of the associated photo-couplers 3*e*, and the photo-couplers changes the bit pattern of a key position signal. When the pianist releases the depressed black/white key 10, the black/white key 10 returns toward the rest position, and the shutter plate 3*d* is sequentially evacuated from the optical paths of the photo-couplers 3*e*. The key position signal changes the bit pattern, again. Thus, the key position signal is representative of the current key position of the associated black/white key 10, and the key sensor 3*a* supplies the key position signal to the controller 3*b*.

The controller 3*b* includes a data processor and a tone generator. The data processor analyzes pieces of positional data representative of the variation of the bit pattern to see what key motion the pianist gives rise to. If the pianist gives rise to the downward key motion, the data processor instructs the tone generator to timely supply an audio signal to the headphone 3*c*, and the head-phone 3*c* generates the electronic sound corresponding to the acoustic sound to be produced by the associated hammer assembly 40. On the other hand, if the pianist gives rise to the upward key motion, the data processor instructs the tone generator to decay the audio signal at the timing when the damper felt 54*c* is brought into contact with the set of strings S. Accordingly, the electronic sound is decayed. Thus, the electronic sound generating system 3 generates the electronic sounds corresponding to the acoustic tones along a passage.

The keyboard musical instrument behaves as follows. A pianist is assumed to play a tune in an acoustic sound mode. The pianist keeps the muffler pedal 402 at the rest position, and the change-over mechanism 350 maintains the shank stopper 200 in the free position. While the pianist is playing the tone on the keyboard 4, the depressed black/white keys 10 sequentially actuate the associated action mechanisms 5, and the jacks 26 escapes from the hammer butts 41. The jacks 26 give rise to the free rotations of the associated hammer assemblies 40, and the hammer heads 44 sequentially strike the associated sets of strings S. The strings S vibrate for generating the acoustic tones. Thus, the acoustic piano 1 sequentially generates the acoustic tones along the tune. The shank stopper 200 at the free position does not interrupt the hammer actions.

Figure 9:
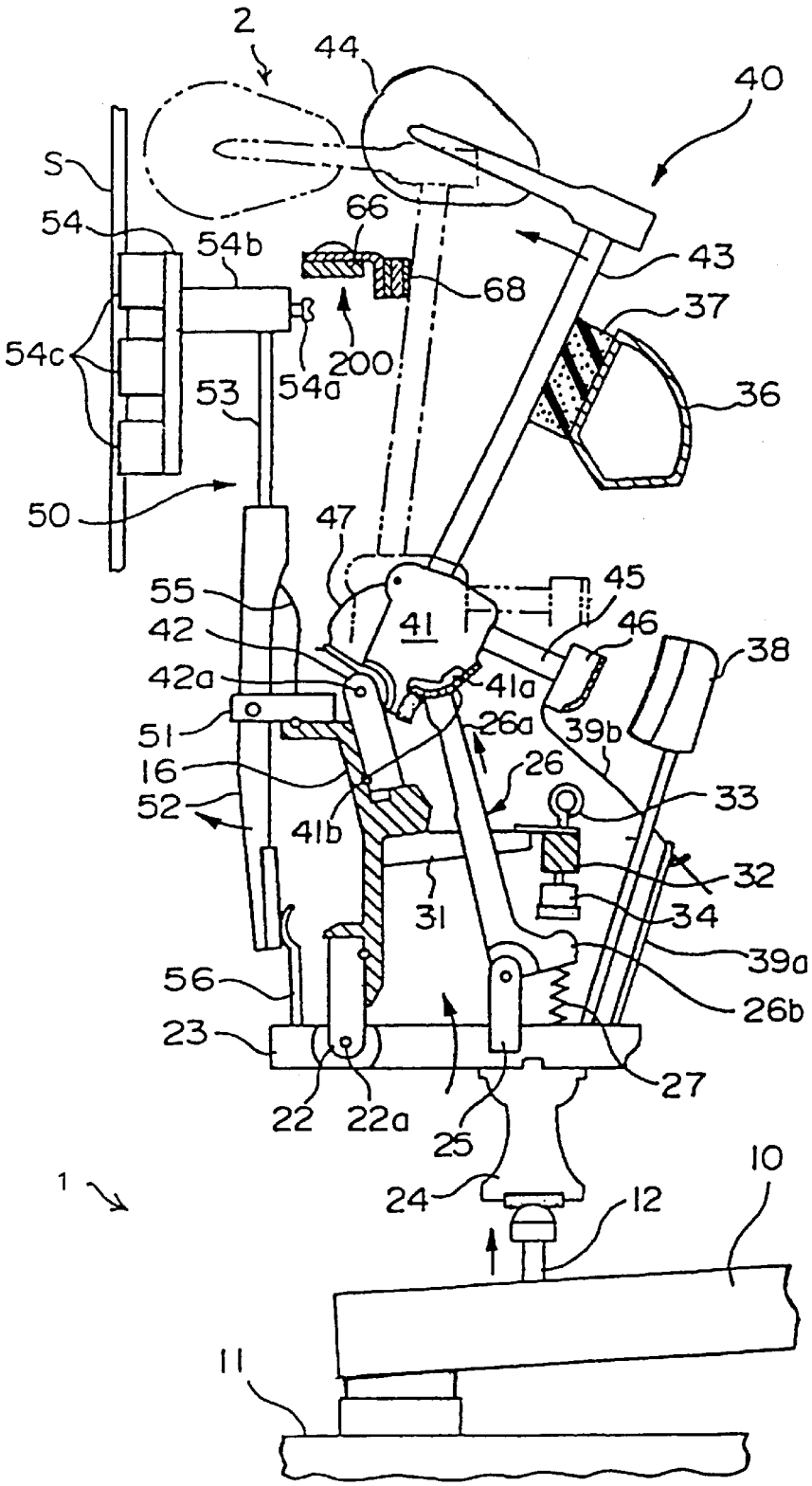
FIG. 9 is a side view showing the keyboard musical instrument in the silent mode.

The pianist is assumed to play a tune in a silent mode. The pianist steps on the muffler pedal 402, and the pawl and the ratchet wheel keep the muffler pedal 402 depressed. The muffler pedal 402 actuates the change-over mechanism 350 so as to change the shank stopper 200 to the blocking position. The impact absorbers 68 are moved into the trajectories of the hammer shanks 43. While the pianist is playing the tune on the keyboard 4, the depressed black/white keys 10 sequentially actuate the action mechanisms 5, and the jacks 26 escape the hammer butts 41. Although the jacks 26 give rise to the free rotations of the hammer assemblies 40, the hammer shanks 43 rebound on the impact absorbers 68 before the hammer heads 44 reach the strings S as shown in FIG. 9. Any acoustic tone is not generated from the strings S.

The key sensors 3*a* are respectively monitoring the associated black/white keys 10 during the fingering on the keyboard 4, and periodically report the current key positions of the black/white keys 10. The data processor analyzes the pieces of positional data. The data processor determines the electronic sounds to be produced in response to the fingering, and instructs the tone generator to generate the audio signal for the electronic sounds. The data processor further determines the electronic sounds to be decayed in response to the fingering, and instructs the tone generator to decay the electronic sounds. Thus, the electronic sound generating system 3 is responsive to the fingering on the keyboard, and sequentially generates the electronic sounds along the tune.

When user requests the manufacturer to add the silent system 2 and the electronic sound generating system 3 to the upright piano 1, the manufacturer sends workmen to user's home. The workmen attach the brackets 62 to the action brackets, and assemble the transmitter 350*a* and the shank stopper 200 with the brackets 62. The workmen regulate the relative position between the base rail 66 and the stopper rail segments 67*a*/67*b*/67*c* so as to adjust the shank stopper 200 to the optimum blocking position. The workmen fixes the base plate 306 and the anchor 311 to the side board 304, and connect the muffler link 400 to the arm member 308. The workmen regulate the position of the muffler link 400 with respect to the notch 308*a* so as to adjust the pusher 300 at the optimum rear position. The pusher 300 at the optimum rear position is held in contact with the arm member 202 at the free position. Thus, the transmitter 350*b* and the shank stopper 200 are independently regulated to the optimum positions. The workmen install the electronic sound generating system 3 inside the upright piano, and complete the retrofitting.

The manufacturer is assumed to replace a part of the transmitter 350*a*/350*b* or a part of the shank stopper with new one. The manufacturer sends workmen to user's home, and the workmen disassemble the transmitter 350*a* or the transmitter 350*b* assembled with the shank stopper 200. The transmitter 350*a* is only in contact with the transmitter 350*b*. For this reason, the transmitter/shank stopper 350*a*/200 or the other transmitter 350*b* remains inside the acoustic piano 1. The transmitter 350*a* or the other transmitter/hammer stopper 350*b*/200 is repaired, and, thereafter, assembled with the transmitter 350*b* or 350*a*. The assembling work is easy because the transmitters 350*a* and 350*b* are connected through the contact between the arm member 202 and the pusher 300. Moreover, the muffler pedal 402, the muffler links 400/412/410 and the link levers 41/413 are available for the transmitter 350*b*, and only a few new parts are required for the retrofitting.

In this instance, the upright piano 1 serves as an acoustic keyboard. The force is transmitted from the pusher 300 to the arm member 202, and the direction to transmit the force to the arm member 202 is corresponding to a second direction. The pusher 300 is not linked with the arm member 202 in a direction opposite to the force transmitting direction, and, accordingly, the opposite direction is corresponding to a first direction. The first direction may be any direction except the force transmitting direction. When the rail base 66 is brought into contact with the stopper portions 62*e*, the torsion spring 201*a* does not urge the arm member 202 to keep the contact with the pusher 300. The position at which the rail base is brought into contact with the stopper portion 62*e* defines a boundary of a predetermined range.

Second Embodiment

Figure 10:
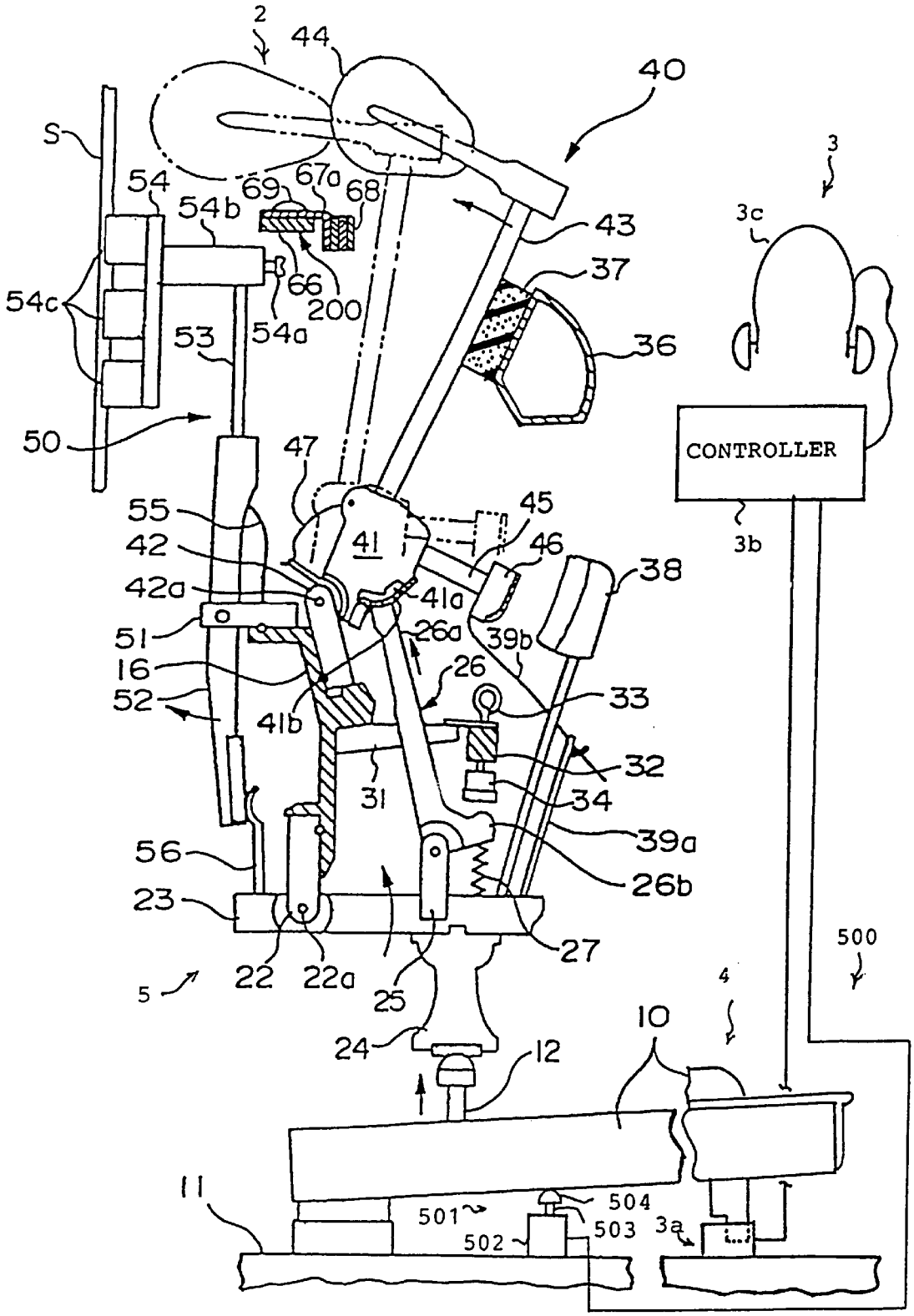
FIG. 10 is a side view showing essential parts of another keyboard musical instrument according to the present invention.

FIG. 10 illustrates another keyboard musical instrument embodying the present invention. The keyboard musical instrument implementing the second embodiment largely comprises an acoustic piano, a silent system, an electronic sound generating system and an automatic playing system 500. The acoustic piano, the silent system and the electronic sound generating system are similar to those of the first embodiment, and parts are labeled with the same references designating the corresponding parts of the first embodiment. Description is hereinbelow focused on the automatic playing system 500.

The automatic playing system 500 includes solenoid-operated key actuators 501 and the controller 3*b*. The controller 3*b* is shared between the automatic playing system 500 and the electronic sound generating system 3. However, computer programs for controlling the automatic playing system 500 are further stored in the program memory (not shown). The solenoid-operated key actuators 501 are placed on the key bed 11, and are respectively associated with the black/white keys 10. The solenoid-operated key actuators 501 are similar in structure to one another, and each solenoid-operated key actuator 501 has a solenoid 502, a plunger 503 and a cushion 504. The solenoid 502 is mounted on the key bed 11, and is connected to a driver circuit (not shown) of the controller 3*b*. The plunger 503 is upwardly projectable from and downwardly retractable into the solenoid 502, and the cushion 504 is attached to the leading end of the plunger 503.

A set of music data codes is stored in a working memory (not shown) of the controller 3*b*, and the data processor sequentially reads out the music data codes from the working memory. The data processor checks the music data codes to see whether or not any solenoid-operated key actuator 501 is energized. If the music data code is representative of a key-on event, the data processor instructs the driver circuit to supply a driving signal to the solenoid. Then, the plunger 503 projects from the solenoid 502, and pushes the associated black/white key 10. On the other hand, if the music data code is representative of a key-off event, the data processor instructs the driver circuit to decay the driving signal, and the plunger 503 is retracted into the solenoid 502. Thus, the array of solenoid-operated key actuators selectively moves the black/white keys 10 without any fingering, and plays a tune on the keyboard 4.

The keyboard musical instrument implementing the second embodiment behaves as similar to the first embodiment in the acoustic sound mode and the silent mode, and no further description is incorporated hereinbelow.

As will be appreciated from the foregoing description, the change-over mechanism has the transmitters 350*a*/350*b* held in contact with each other without any binding. The transmitters 350*a*/350*b* are independently disassembled and regulated. This results in easy repairing work or easy retrofitting.

Although particular embodiments of the present invention have been shown and described, it will be apparent to those skilled in the art that various changes and modifications may be made without departing from the spirit and scope of the present invention.

The pedal 402 may be newly added to the acoustic piano 1. In this instance, the acoustic piano may have the pedal 402, the soft pedal 401, the damper pedal 403 and a muffler pedal connected to a muffler frame.

The pusher 300 may be connected through a suitable transmission mechanism to a grip, which the pianist manipulates.

The pusher 300 may be directly or indirectly connected to a suitable actuator such as, for example, a solenoid-operated actuator. The sliding box 303 may be moved by means of a suitable actuator such as, for example, a ball tread unit connected to an electric motor.

The pusher 300 may bi-directionally push the arm member 202. In this instance, the torsion spring 201*a* is deleted from the transmitter 350*a*.

The acoustic piano 1 may be a grand piano. The present invention is applicable to another kind of acoustic keyboard musical instrument such as, for example, a celesta. The celesta, the grand piano and the upright piano serve as an acoustic keyboard.

What is claimed is:

1. keyboard musical instrument comprising an acoustic keyboard including plural keys respectively assigned pitch names and selectively depressed by a player, plural music strings respectively associated with said plural keys and plural strikers driven by depressing said plural keys for striking the associated music strings, and a silent system including a stopper moved between a free position and a blocking position so that said plural strikers strike said plural music strings without any interruption thereof at said free position and rebound thereon at said blocking position before striking said plural music strings and a change-over mechanism having a first transmitter connected to said stopper for changing said stopper between said free position and said blocking position and a second transmitter held in contact with said first transmitter without any restriction in a first direction for transmitting a force to said first transmitter in a second direction different from said first direction.

2. The keyboard musical instrument as set forth in claim 1, in which said first transmitter and said second transmitter have a first member and a second member held in contact with each other, respectively, and said change-over mechanism further has an elastic member urging one of said first and second members in a direction to keep said first and second members in contact with each other in so far as the other of said first and second members is in a predetermined range.

3. The keyboard musical instrument as set forth in claim 2, in which said elastic member urges said stopper through said one of said first and second members toward said free position.

4. The keyboard musical instrument as set forth in claim 3, in which said stopper urges said one of said first and second members in a direction opposite to the direction toward said free position when said strikers give impact to said stopper in said blocking position.

5. The keyboard musical instrument as set forth in claim 4, in which said first transmitter further has a first pin connected between a stationary member and said first member so as to allow said first member to be rotated therearound, a second pin provided between said first member and one end portion of said stopper so as to allow said first member and said stopper to turn with respect to each other, a third member located around the other end portion of said stopper, a third pin connected between another stationary member and said third member so as to allow said third member to be rotated therearound, a fourth pin provided between said third member and said other end portion of said stopper so as to allow said third member and said stopper to turn with respect to each other, said first pin, said second pin, said third pin and said fourth pin being arranged in such a manner that four virtual lines therebetween form a parallel four link mechanism, and said elastic member connected to said first member so as to urge said stopper to turn around said first and third pins in said direction toward said free position.

6. The keyboard musical instrument as set forth in claim 1, in which said acoustic keyboard is a piano.

7. The keyboard musical instrument as set forth in claim 6, in which said acoustic keyboard further includes plural action mechanisms respectively connected to said plural keys and selectively actuated by the associated keys so as to drive hammers respectively serving as said strikers for rotation toward said associated music strings.

8. The keyboard musical instrument as set forth in claim 6, in which said second transmitter includes a pusher held in contact with said first transmitter and a transmission mechanism connected between said pusher and a pedal depressed by said player.

9. The keyboard musical instrument as set forth in claim 6, in which said piano has a muffler pedal provided between a soft pedal and a damper pedal, and said second transmitter includes muffler links connected in series to said muffler pedal, a pusher held in contact with said first transmitter and a transmission mechanism connected between one of said muffler links and said pusher.

10. The keyboard musical instrument as set forth in claim 8, in which a relative position between said pusher and said transmission mechanism is regulable.

11. The keyboard musical instrument as set forth in claim 8, in which said pusher is held in contact with a member of said first transmitter by means of an elastic member in so far as said member is in a predetermined range.

12. The keyboard musical instrument as set forth in claim 11, in which said second direction is identical with a direction in which said pusher pushes said member for changing said stopper from said free position to said blocking position.

13. The keyboard musical instrument as set forth in claim 6, further comprising an electronic sound generating system including plural key sensors respectively associated with said plural keys and detecting current positions of said plural keys for producing key position signals representative of said current positions, a controller connected to said plural key sensors and producing an audio signal representative of electronic sounds having the pitch names identical with those assigned to the depressed keys, and a sound system connected to said controller and producing said electronic sounds from said audio signal.

* * * * *